US009604741B2

(12) United States Patent
Drechsler et al.

(10) Patent No.: US 9,604,741 B2
(45) Date of Patent: Mar. 28, 2017

(54) THERMO-FORMING PACKAGING MACHINE WITH INTEGRATED PRODUCT FEEDER

(71) Applicant: Multivac Sepp Haggenmüller GmbH & Co. KG, Wolfertschwenden (DE)

(72) Inventors: Martin Drechsler, Trunkelsberg (DE); Johannes Mühlschlegel, Aitrach (DE); Christoph Vetter, Altusried (DE); Matthias Storhas, Babenhausen (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 121 days.

(21) Appl. No.: 14/209,935

(22) Filed: Mar. 13, 2014

(65) Prior Publication Data

US 2014/0260123 A1 Sep. 18, 2014

(30) Foreign Application Priority Data

Mar. 14, 2013 (EP) ..... 13159281

(51) Int. Cl.

| | |
|---|---|
| ***B65B 41/14*** | (2006.01) |
| ***B65B 9/04*** | (2006.01) |
| ***B65B 35/54*** | (2006.01) |
| ***B65B 35/24*** | (2006.01) |
| ***B65B 47/00*** | (2006.01) |
| ***B65B 5/02*** | (2006.01) |
| *B65B 35/16* | (2006.01) |

(Continued)

(52) U.S. Cl.

CPC ..... *B65B 5/026* (2013.01); *B65B 35/24* (2013.01); *B65B 5/12* (2013.01); *B65B 35/16* (2013.01); *B65B 41/12* (2013.01); *B65B 47/00* (2013.01)

(58) Field of Classification Search

CPC .. B65B 5/068; B65B 5/08; B65B 9/04; B65B 9/045; B65B 11/52; B65B 35/16; B65B 35/18; B65B 35/24; B65B 41/12; B65B 41/14; B65B 47/00–47/10; B65B 57/10; B65B 65/003; B65B 65/006

USPC ..... 53/559, 393, 493–500, 389.2, 251

See application file for complete search history.

(56) References Cited

U.S. PATENT DOCUMENTS 4,351,141 A * 9/1982 Glorfield ..... B65B 1/30 141/131
4,819,406 A * 4/1989 Redmond ..... B65B 57/04 53/133.1

(Continued)

FOREIGN PATENT DOCUMENTS

DE 102005039673 A1 11/2006
EP 0162933 A1 12/1985

(Continued)

*Primary Examiner* — Andrew M Tecco
*Assistant Examiner* — Praachi M Pathak
(74) *Attorney, Agent, or Firm* — Husch Blackwell LLP

(57) ABSTRACT

The invention relates to a thermo-forming packaging machine comprising a product feeder for feeding a product to a loading stretch of the packaging machine, and a film web having trays formed therein wherein the trays are configured to receive a product. The product feeder may be arranged at least partially parallel to the loading stretch of the packaging machine. The thermo-forming packaging machine also includes a side panel disposed along the loading stretch that is formed such that it also forms part of the product feeder.

13 Claims, 2 Drawing Sheets

(51) Int. Cl.
*B65B 41/12* (2006.01)
*B65B 5/12* (2006.01)

(56) References Cited

U.S. PATENT DOCUMENTS 4,957,571 A * 9/1990 Cipolla ..... B29C 53/18
156/499
4,961,488 A * 10/1990 Steeghs ..... A21C 9/08
198/357
5,426,919 A * 6/1995 Natterer ..... B65B 65/00
198/841
2003/0037515 A1 * 2/2003 Herzog ..... B65B 5/105
53/473

FOREIGN PATENT DOCUMENTS

WO WO 2008095500 A2 * 8/2008 ..... A22C 17/008
WO 2009106879 A1 9/2009

* cited by examiner

THERMO-FORMING PACKAGING MACHINE WITH INTEGRATED PRODUCT FEEDER

CROSS-REFERENCE TO RELATED APPLICATIONS

This Application claims priority to European Patent Application Number 13159281.8 filed Mar. 14, 2013, to Martin Drechsler, Johannes Mühlschlegel and Christoph Vetter entitled "Thermo-Forming Packaging Machine with Integrated Product Feeder," currently pending, the entire disclosure of which is incorporated herein by reference.

FIELD OF THE INVENTION

The invention relates to a thermo-forming packaging machine wherein a side panel disposed along the loading stretch may be formed such that it simultaneously forms part of the product feeder.

BACKGROUND OF THE INVENTION

DE 10 2005 039 673 A1 discloses a continuously operating thermo-forming packaging machine with two container lanes between which a product feeder belt is arranged. The work stations such as forming, loading or filling, sealing and cutting stations are each designed as a modular module with separate frames and housing.

With intermittently operating thermo-forming packaging machines typically comprising a continuous and non-housed frame construction, products for automatic loading using a picker are approached via one or more feeder belts to the thermo-forming packaging machine in the region of the loading stretch. The lateral distance between the product feeder belts and the packaging containers formed into a film web often depends on the space required by the web conveying chain guide, the machine frame and the side coverings on both sides of the thermo-forming packaging machine. This lateral distance must be accommodated and when transferring the products from the feeder belt using a picker for every transfer motion and the stroke or cycle time depends inter alia on this distance.

SUMMARY OF THE INVENTION

The object of the present invention is to improve a thermo-forming packaging machine in terms of reducing the distance between the product feeder and the containers in order to minimize the cycle time for the picker to load a product.

The thermo-forming packaging machine according to the invention may comprise a product feeder module, hereinafter always referred to as "product feeder", where the product feeder may be arranged in part parallel to a loading stretch of the thermo-forming packaging machine, and the machine may comprise a side panel on the inner side of which a chain guide can be attached for a film clamp chain. The thermo-forming packaging machine is characterized in that the side panel being disposed along the loading stretch of the packaging machine is formed such that the side panel is also a part of the product feeder. The multiple functionality of this side panel may be (1) to receive the chain guide for transporting the film web and thereby the containers within and along or within the thermo-forming packaging machine, respectively, and (2) to form a part of the product feeder. This has the enormous advantage that the distance between the products supplied on the product feeder and the containers formed in the film web are reduced to a minimum. To this end, in one embodiment, a clear distance between the inner wall of the product feeder and the proximate outer edge of the film web should not exceed 125 millimeters. In addition, the distances for transferring the products into the containers are thereby reduced, resulting in an increase in performance of the thermo-forming packaging machine as the advancement increment may be reduced and/or the conveying speed of the film web through the loading station may be decreased. Containers are understood here as trays that are formed in a forming station into a film web prior to being supplied to the loading stretch. The media lines, such as cables and hoses commonly running along the side frame, can be installed e.g. in a lower section of the machine frame and any possibly necessary side coverings of the machine frame of the thermo-forming packaging machine can be implemented at the outer side of the product feeder.

Preferably, the side panel may be an inner side wall of the product feeder. In an advantageous embodiment, axles and/or spacers may be provided as connecting elements between the side panel as the inner sidewall and the outer sidewall of the product feeder. This makes it possible that devices such as a mounting drive and/or cam roller are provided in the side walls and the feeder belt body can run in close proximity to the side panel and hence to the chain guide or the film web, respectively. The inner and outer side wall of the product feeder together with the axles and/or spacers, form a bending-and torsion-resistant structure which is able to provide additional support and/or rigidity of the side panel.

A direction of production of the thermo-forming packaging machine and a transport direction of the product feeder may be preferably oriented in the same direction to maintain a continuous overall direction of production during the packaging process and to reduce the base area required, for example, in order to be able to set up two packaging lines adjacent to each other with the least possible spacing.

Preferably, the product feeder may comprise a curved belt to run laterally along a front region of the packaging machine and then to be attached directly to the side panel in the region of the loading stretch. The curved belt allows an S-shaped course of the product feeder.

In an alternative advantageous embodiment, the product feeder may be arranged upstream of the loading stretch in part above a forming station of the thermo-forming packaging machine in order to enable a straight run of the product feeder.

Product feeders may be preferably arranged on both sides of the thermo-forming packaging machine, for example, in order to replace a wide product feeder belt on which products are transported in two lanes by two narrow product feeder belts. In this manner, all products are transported at a minimum distance to the containers along the loading stretch.

One advantageous embodiment provides at least one robot along the loading stretch to transfer products from the product feeder into trays that were thermo-formed into a film web. Such automation increases the output of the thermo-forming packaging machine while simultaneously providing a short loading stretch. The loading stretch would need to be many times longer with manual loading by multiple operators.

A position detection device may be preferably provided for detecting the positions of products on the product feeder in order for the robot to be able to receive and/or grip and transfer the products being conveyed or fed in an unaligned manner. In this embodiment, the position detection device is preferably a vision system.

Preferably, the loading stretch begins directly downstream of the forming station in order to minimize the space required for the thermo-forming packaging machine so that the overall packaging machine length can be as short as possible. A cover was commonly provided in conventional thermo-forming packaging machines downstream of the forming station which prevented unwanted hazardous intervention by an operator in-between the moving parts of the forming station. At the same time, however, loading products into the already formed trays was also prevented in the region of this cover. In a variant of the present invention, however, the housing of the picker or the robot, respectively, can be brought forward so far that the picker or the robot is immediately adjacent to the forming station or even partially overlaps with the forming station. In this manner, an additional cover can be omitted because the housing or the portal of the picker or robot assumes the function of the cover. This alternative embodiment makes it possible for products to be loaded into the formed trays immediately after the end of the forming station, i.e. that the loading stretch can begin immediately downstream of the forming station. This alternative embodiment may be particularly advantageous when the product feeder supplies the products in a direction counter to the direction the trays in the film web are conveyed in the loading stretch, i.e. opposite the production direction of the trays in the loading stretch.

It is also conceivable that the product feeder may comprise an outer side wall that can be supported on the ground with at least one leg. The product feeder may then be attached to one side of the side frame of the thermo-forming packaging machine and be supported on the other side on the ground to improve support stability, especially when a wide product feeder belt is used.

Other aspects and advantages of the present invention will be apparent from the following detailed description of the preferred embodiments and the accompanying drawing figures.

DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
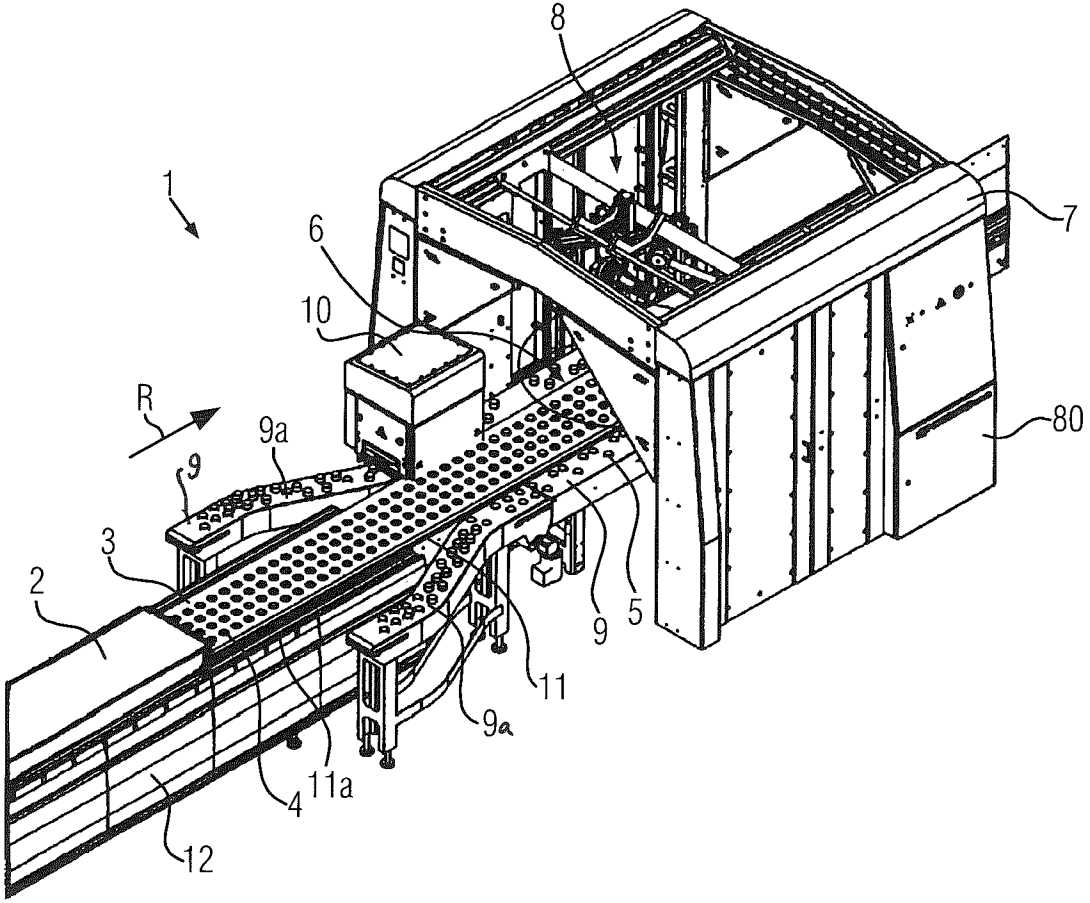
FIG. 1 shows a perspective view of the thermo-forming packaging machine with product feeders provided at both sides, a robot and a vision system.

FIG. 1 shows one embodiment of a thermo-forming packaging machine 1 of the present invention having a direction of production R. The thermo-forming packaging machine 1 may comprise a forming station 2 in which trays 4 are formed into a film web 3 into which products 5 are placed. A portal 7 with a picker or a robot 8, respectively, is arranged above a loading stretch 6 of the packaging machine 1 to transfer the products 5 from a product feeder 9 and to place them into the trays 4. In one embodiment, each product feeder 9 may include a curved belt 9*a*. However, as described above, belt 9*a* does not have to curve. A vision system 10 for the product feeder 9 may be arranged in the direction of production R upstream of the loading stretch 6 to detect the position of the products 5 on the product feeder 9 to accordingly control the robot 8 with a control unit 80, so that the robot 8 can transfer the products 5 securely from the product feeder 9 and place them into the trays 4 in an accurate position. Another vision system 10 may be disposed on the near product feeder 9, but is not shown for reasons of better illustration. A sealing station for applying a top film and at least one cutting station for separating the sealed packages may be disposed subsequently downstream of the loading stretch 6, but are not shown in FIG. 1. The direction of production R of the film web 3 is oriented in substantially the same direction as the direction of transport of the products 5 on the product feeder 9, i.e. in synchronism. It is also conceivable, in an alternative embodiment not shown, that the product feeder 9 feeds the products 5 to the loading stretch 6 in the counter direction to the production direction.

As further shown in FIG. 1, in a front section along the forming station 2, a side covering 12 may be attached on both sides to a side frame 11 of the packaging machine 1 to prevent access to the power-operated lifting mechanisms disposed between the side frames 11. No side coverings 12 are provided along the loading stretch 6, and the side frame 11 may have a special configuration which shall be explained in more detail with reference to FIG. 2.

Figure 2:
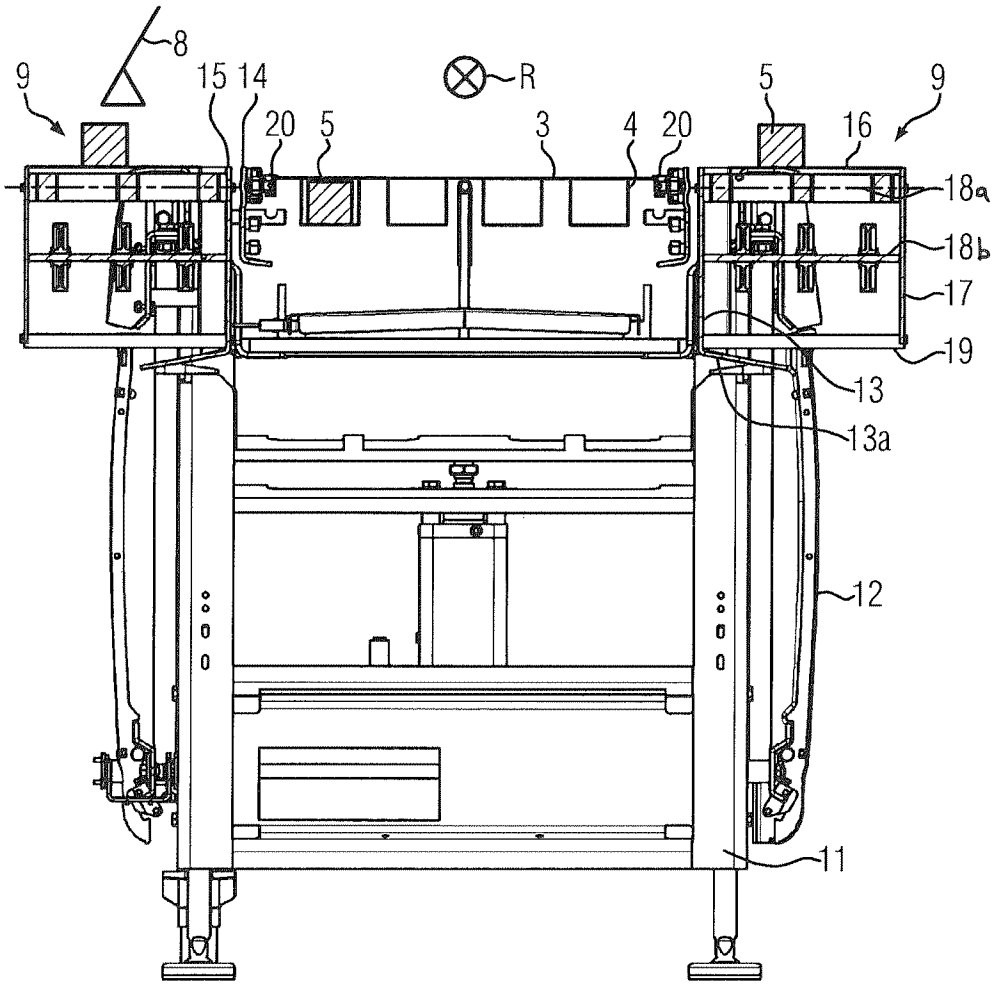
FIG. 2 shows a sectional view in the direction of production through the loading stretch.

FIG. 2 shows a sectional view in the loading stretch 6 looking in the direction of production R. The product feeders 9 are each mounted on the right and left at a side panel 13 respectively. The side panel 13 in the region of the loading stretch 6 may be designed to have an L-shape, wherein a leg 13*a* may be oriented horizontally and outwardly and having a downward inclination. This configuration allows side panel 13 to be easily washable and cleaning liquids can run off easily. The side panel 13 is connected both at the beginning as well as at the end with a frame section 11*a* (shown in FIG. 1) of the packaging machine on which the side coverings 12 are in turn provided. The side panel 13 may fulfill two functions. First, a chain guide 14 may be attached with bolts 15 or other fastener to the inner side of the side panel 13. Second, the product feeder 9 may be attached to the outer side of the side panel 13. In this manner, the products 5 being conveyed on a belt body 16 of the product feeder 9 can be supplied to the robot 8 with very little distance to the trays 4 in the film web 3 and along the film web 3. Thus, the robot 8 is required to only move short transport distances and, therefore, only a short time to take up the products 5 from the belt body 16 and place them it into the trays 4.

As further shown in FIG. 2, the product feeder 9 may comprise two side walls. One side wall 17 is provided on the respective outer side of the product feeder 9. The inner side wall of the product feeder 9 is formed by the side panel 13. Both axles 18*a* and 18*b* for supporting and driving the belt body 16 as well as further spacers 19 connect the side wall 17 and the side panel 13 to each other and form a torsion and bending-resistant system or frame. The product feeder 9 may thereby aid or enhance the support strength or rigidity of the side panel 13.

The invention is not restricted to an L-shaped profile shape of the side panel 13. It is also conceivable that the horizontally oriented leg 13*a* of the side panel 13 extends to the outer side wall 17 of the product feeder 9 and comprises multiple boltings or couplings with the latter. The side panel 13 is preferably made of a steel or stainless steel plate and, preferably, has a thickness of at least five millimeters (5 mm) in order to provide the stability or rigidity that is advantageous for the thermo-forming packaging machine 1, which is also provided in the regions upstream and downstream of the loading stretch 6. The requisite rigidity and stability is necessary in order to be able to accurately transport the film web 3 with the film clamping chain 20 in the direction of production R in a tensioned manner within the thermo-forming packaging machine 1.

In lieu of a picker or robot 8, an embodiment of the present invention also includes the products 5 being manually removed from the feeder belt 9 along the loading stretch 6 and placed in the trays 4 by one or more persons.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

What is claimed is:

1. Thermo-forming packaging machine comprising:

a loading stretch, wherein in operation of the thermo-forming packaging machine, one or more containers formed in a packaging film are filled in the loading stretch;

a product feeder for conveying a plurality of products, a portion of a length of said product feeder being arranged parallel to said loading stretch of said thermo-forming packaging machine;

said product feeder comprising a side panel, wherein said side panel is an inner side wall of said product feeder, and wherein at least a portion of said inner side wall is disposed laterally adjacent to said loading stretch to reduce a distance between the products conveyed on the product feeder and the containers formed in the film web to a minimum; and one or more axles and/or one or more spacers provided as connecting elements between said inner side wall and an outer sidewall of said product feeder.

2. Thermo-forming packaging machine according to claim 1, wherein in said loading stretch, a direction of production of said thermo-forming packaging machine and a direction of transport of said product feeder are oriented in the same direction.

3. Thermo-forming packaging machine according to claim 1, wherein at least a portion of said product feeder comprises a curved belt.

4. Thermo-forming packaging machine according to claim 1, wherein said product feeder is arranged in part above said forming station of said thermo-forming packaging machine.

5. Thermo-forming packaging machine according to claim 1 further comprising two product feeders, wherein one of said product feeders is arranged on each side of said thermo-forming packaging machine.

6. Thermo-forming packaging machine of claim 1 further comprising a film clamp chain for conveying said packaging film through said thermo-forming packaging machine, and said inner side wall having a first side, wherein a film clamp chain guide for guiding said film clamp chain is attached to said first side of said inner side wall at said portion of said length of said product feeder.

7. Thermo-forming packaging machine of claim 1 further comprising a forming station upstream of said loading stretch, and one of a picker or a robot for transferring products from the product feeder into the containers in said loading stretch, said picker or said robot disposed one of (a) downstream and immediately adjacent to the forming station, or (b) partially downstream and at least partially overlapping the forming station.

8. Thermo-forming packaging machine of claim 7 wherein a housing of the picker or the robot covers the forming station.

9. A thermo-forming packaging machine comprising:

a film clamp chain for conveying a film web in a production direction;

a film clamp chain guide for guiding the film clamp chain; and a product feeder for conveying a plurality of products in a feed direction, said product feeder having a length, a portion of said length of said product feeder being disposed laterally adjacent and parallel to a loading stretch of said thermo-forming packaging machine, said product feeder further comprising an inner side wall, an outer side wall, and one or more axles and/or one or more spacers provided as connecting elements between said inner side wall and said outer sidewall, and;

wherein said portion of said length of said product feeder includes said inner side wall disposed laterally adjacent to said loading stretch, said inner side wall having a first side, and wherein said film clamp chain guide is coupled directly to said first side of said inner side wall.

10. The thermo-forming packaging machine of claim 9 further comprising at least one robot disposed along said loading stretch to transfer products from said portion of said length of said product feeder into one or more trays formed in said film web.

11. The thermo-forming packaging machine of claim 9 further comprising a forming station for forming said trays in said film web, and wherein said loading stretch is directly downstream of said forming station of said thermo-forming packaging machine.

12. Thermo-forming packaging machine of claim 9 wherein said feed direction of said product feeder at said portion of said length of said product feeder is the same direction as the production direction.

13. Thermo-forming packaging machine of claim 9 wherein said feed direction of said product feeder at said portion of said length of said product feeder is in the opposite direction as the production direction.

* * * * *